United States Patent [19]

Conrad et al.

[11] Patent Number: 4,627,369

[45] Date of Patent: Dec. 9, 1986

[54] SYSTEM FOR IMPROVING EMBROIDERED ARTICLES

[75] Inventors: Erich H. Conrad, Asheville; Bernhard Conrad, Weaverville; Robert L. Anderson; Gilbert E. Carlson, both of Asheville, all of N.C.

[73] Assignee: Conrad Industries, Inc., Weaverville, N.C.

[21] Appl. No.: 508,139

[22] Filed: Jun. 27, 1983

[51] Int. Cl.[4] ..... D05C 9/06; D05B 21/00

[52] U.S. Cl. ..... 112/103; 112/121.12; 112/84

[58] Field of Search ..... 112/121.12, 121.11, 112/102, 103, 79 A, 79 R, 121.15, 84, 85, 86; 318/574, 569, 600

[56] References Cited

U.S. PATENT DOCUMENTS

| | | | |
|---|---|---|---|
| 3,128,374 | 4/1964 | Ho et al. | 112/121.12 X |
| 3,266,448 | 8/1966 | Haggar | 112/84 |
| 3,822,658 | 7/1974 | Conner, Jr. | 112/121.12 |
| 4,271,770 | 6/1981 | Heinzle | 112/84 |
| 4,275,674 | 6/1981 | Carbonato et al. | 112/158 E |
| 4,365,564 | 12/1982 | Sugiyama | 112/121.12 |
| 4,580,511 | 4/1986 | Comploi et al. | 112/84 |

*Primary Examiner*—Peter Nerbun

*Attorney, Agent, or Firm*—David M. Carter

[57] ABSTRACT

A system is provided for improving frame adjustments of automatic embroidery machines. Groupings of holes are punched in an elongated tape corresponding to binary numbers. The tape is read by an electro-optical reader which converts the information on the tape to electrical pulses which, in turn, control a drive system for causing the embroidery frame to move predetermined discrete distances.

4 Claims, 5 Drawing Figures

SYSTEM FOR IMPROVING EMBROIDERED ARTICLES

BACKGROUND OF THE INVENTION

This invention relates to automatic embroidery machines. More particularly it relates to a system and method for improving the adjustments of automatic embroidery machines to manufacture an improved embroidered article.

Many years ago embroidery machine frames were adjusted by hand for each stitch change in the embroidered article. The advent of automatically controlled embroidery machines was a significant advance in the art both in frame movement speed and in the large number of articles which may be simultaneously embroidered. Normally these machines are controlled by an elongated tape, sometimes referred to as a Jacquard tape, having holes punched therein. The holes contain the stitch length, direction and function information which is read by an optical reader. The information is converted to electrical pulses and fed to a stepper motor which is, in turn, coupled to a torque amplifier to cause the large embroidery frame to move. The stepper motor and torque amplifier are referred to as the frame drive system.

In the past the resolution or distance increment movement of the frame drive system has been a bottleneck in providing embroidered articles of very fine stitch resolution. In one system known as the Vomag system the stitch resolution has been 1/6 mm. and in another system called the Saurer system the resolution has been 1/10 mm. The Vomag system is also sometimes referred to as the Plauener or Zahn system. With the advent of improved drive systems, including better stepper motors, there is a possibility of great improvement in stitch resolution. Finer resolution would greatly improve the quality of embroidered articles.

A major limiting factor in improving the resolution would be the requirement to use new technology such as magnetic disks, 8-channel tapes and other means which would require the abandonment of all existing Jacquard tapes and their respective patterns, or building special equipment to convert existing tapes to a new format. This would involve large investments in additional equipment, high costs of producing conversions and costly delays in production while awaiting for conversion.

Jacquard tapes, such as the one illustrated in FIG. 1, have been provided for programming the above-mentioned lower resolution systems. The system which is illustrated in FIG. 1 happens to show the Vomag system, which is adapted to provide 1/6 mm. resolution for stitches. Another system which also utilizes Jacquard tapes is the so-called Saurer system, which provides for 1/10 mm. resolution. However, for simplicity sake the Saurer system will not be further described in detail, although the principles are basically the same.

The Vomag system utilizes a plurality of rows 10, each of which is divided into a left side 12 and a right side 14, each of which has 18 spaces. The left side controls the vertical frame movement and the right side controls the horizontal frame movement. The direction of the frame movement along the X axis and Y axis is controlled by outer function holes 16. Other outer holes control certain other functions of the embroidery machine.

In order to indicate stitch length and angular direction either 0, 1 or 2 holes are punched in each line 12 and 14. The spaces on each line are weighted, and count 1 to 10 from the center out with each number indicating the movement of 1/16 mm. The remaining spaces represent the numbers 10 to 90 in ascending units of 10. Therefore, if holes appeared in the space 70 and the space 4, the resulting number would be 74 and the machine would then move 74/6 mm. on the vertical axis. If the horizontal axis holes indicated 23, the machine would move 23/6 mm. horizontally. The resultant vector of combining 74/6 mm. and 23/6 mm. would yield the angular direction and length of stitch. The existence of or lack of hole spaces 16 in the margin determine whether or not you go in the plus or minus direction for each axis.

The width of the tape, the distance between adjacent rows and adjacent spaces for receiving hole punchings are fixed for tapes encoded using the Vomag system so that machines that do the hole punchings as well as readers may be standarized. The same is true for tape encoded under the Saurer system.

These prior art systems have served the embroidery industry well and have been acceptable where stitch resolution is limited to 1/6 or 1/10 mm. because of limitations in the prior art drive systems and frame movement devices. However, with the advent of drive systems which are capable of providing improved resolutions, the Vomag and Saurer systems are not able to handle improved resolutions. For example, in the Vomag system there are only 99 possible frame movement increments for each axis. In a high stitch resolution such as a 1/30 mm. the longest stitch length would be 99/30 mm. which is unacceptable. Therefore, there exists a need to provide a new tape reading system which utilizes the higher resolution drive system which is still compatible with the prior art tape system.

OBJECTS OF THE INVENTION

It is therefore one object of this invention to provide a system for improving the adjustments of automatically operated embroidery machines.

Another object is to provide a system for improving the resolution and stitch length of embroidery machines which is substantially compatible with older systems.

A further object is to provide an embroidered article of improved stitch resolution and stitch length potential.

SUMMARY OF THE INVENTION

In accordance with one form of this invention there is provided a system for improving adjustments of automatically operated embroidery machines. The system includes an elongated tape having a plurality of rows, each row having a plurality of predetermined spaces. The spaces are to be selectively encoded forming intelligence means on the tape. The intelligence means may take the form of holes punched in the tape. The grouping of holes in each row correspond to a binary number. A device is provided for reading the binary number from the tape and for converting the number into electrical pulses. A mechanical apparatus is utilized for driving the frame of the embroidery machine in the direction and distance in response to the pulses for making an embroidered stitch of improved resolution.

In utilizing the above system, embroidered articles having finer resolution and longer stitch length may be provided very economically. A manufacturer does not need to discard old tape punchings because the identical hole/space format is used. The currently used photoscanners are set up to sense either the old or new system with just some minor changes in programming.

BRIEF DESCRIPTION OF THE DRAWINGS

The subject matter which is regarded as the invention is set forth in the appended claims. The invention itself, however, together with further objects and advantages thereof can be better understood by reference to the following description taken in conjunction with the accompanying drawings in which:

DESCRIPTION OF THE PREFERRED EMBODIMENT

Figure 1:
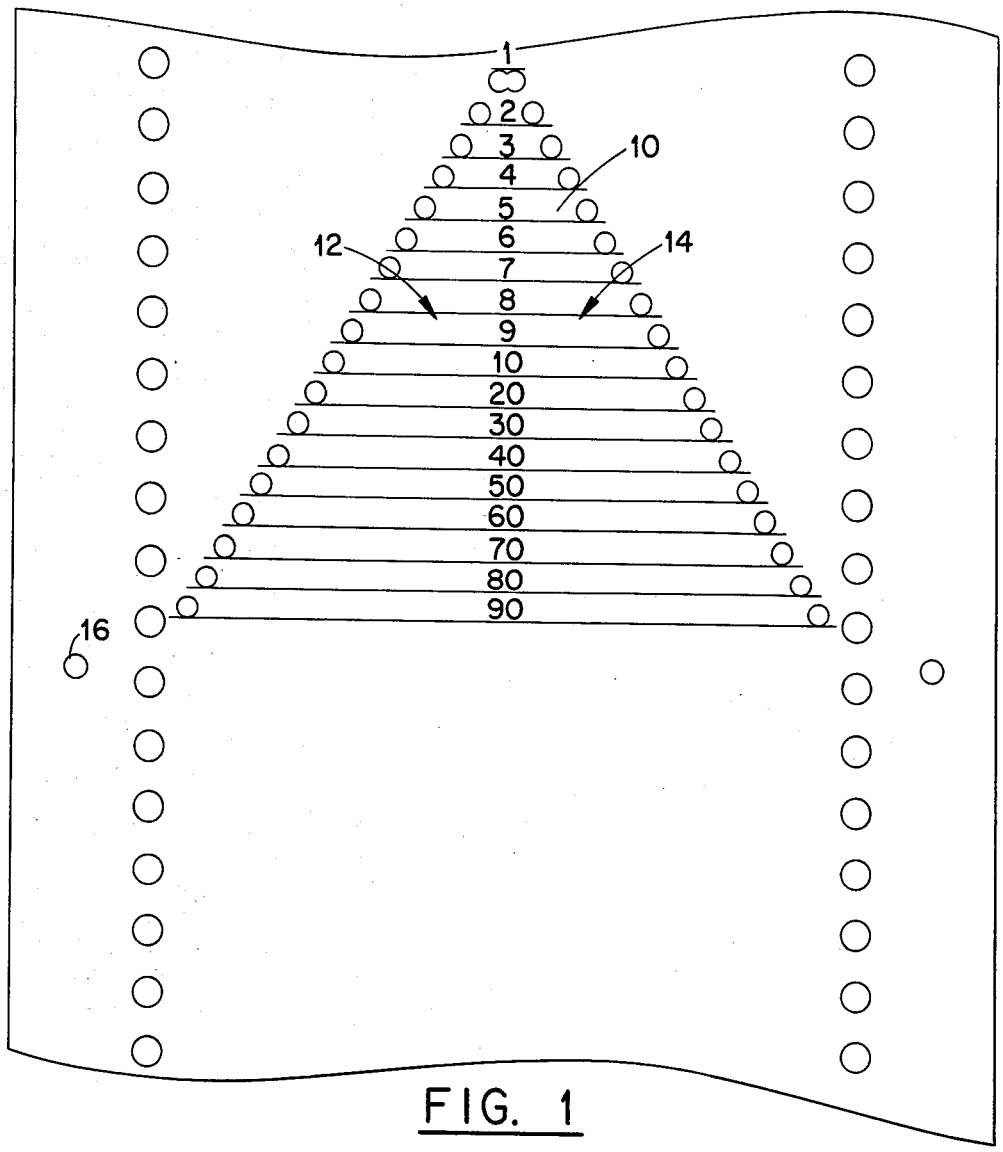
FIG. 1 is a plan view of a prior art tape showing the Vomag system.
Figure 2:
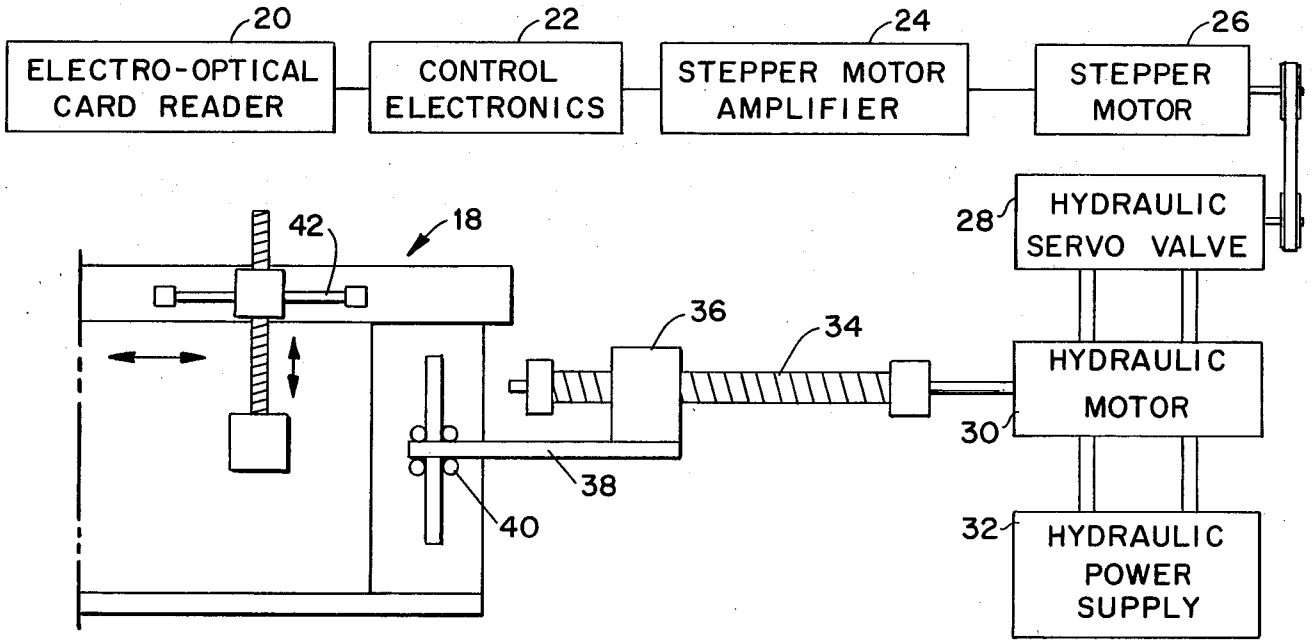
FIG. 2 shows a block diagram of an embroidery machine system which could utilize the invention.

Referring now more particularly to FIG. 2, there is shown a block diagram of the circuits and devices required to operate a Schiffli embroidery machine 18. A standard electrooptical card reader 20 reads a prepunched tape such as the one shown in FIG. 3, which utilizes Applicant's invention, but also is capable of reading a tape using the Vomag system as shown in FIG. 1. The card reader 20 is connected to control electronics 22 which converts the stitch distance and direction data to a corresponding binary pulse train. The control electronics includes the programming for making the conversion, as well as for distinguishing the prior art Vomag or Saurer systems from the binary system which is the subject of the present invention. A switch (not shown) is provided within the control electronics to change from a prior art system to the system of the present invention. The programming required is standard programming which is commonly known to those skilled in the art.

The control electronics is connected to stepper motor amplifier 24, which converts the lower power pulse data from the control electronics to high power pulse data which is required by stepper motor 26. Stepper motor 26 is capable of 1/30 mm. movements or resolution and is commercially available from Berger-Lahr. The stepper motor converts the pulse data information to corresponding rotation at a very low torque. The stepper motor and hydraulic system make up the frame drive system. The stepper motor activates a hydraulic servo valve which, in turn, operates a hydraulic motor 30. The hydraulic motor 30 converts the rotational data from the stepper motor to a correspondingly high torque movement. Hydraulic power supply 32 operates the hydraulic motor 30. The hydraulic system including the valve motor and power supply is available from Stauff Corporation. The hydraulic motor 30 is connected to a ball screw 34 which, in turn, is coupled to ball nut 36. The ball nut and screw are available from the Saginaw Steering Company. Ball nut 36 is connected to rod 38 which, in turn, drives the cam rollers 40. Cam rollers 40 together with the ball nut convert the rotational motion to linear motion for operation of Schiffli machine frame 42. The ball screw and nut could be replaced with a rack and pinion.

Figure 3:
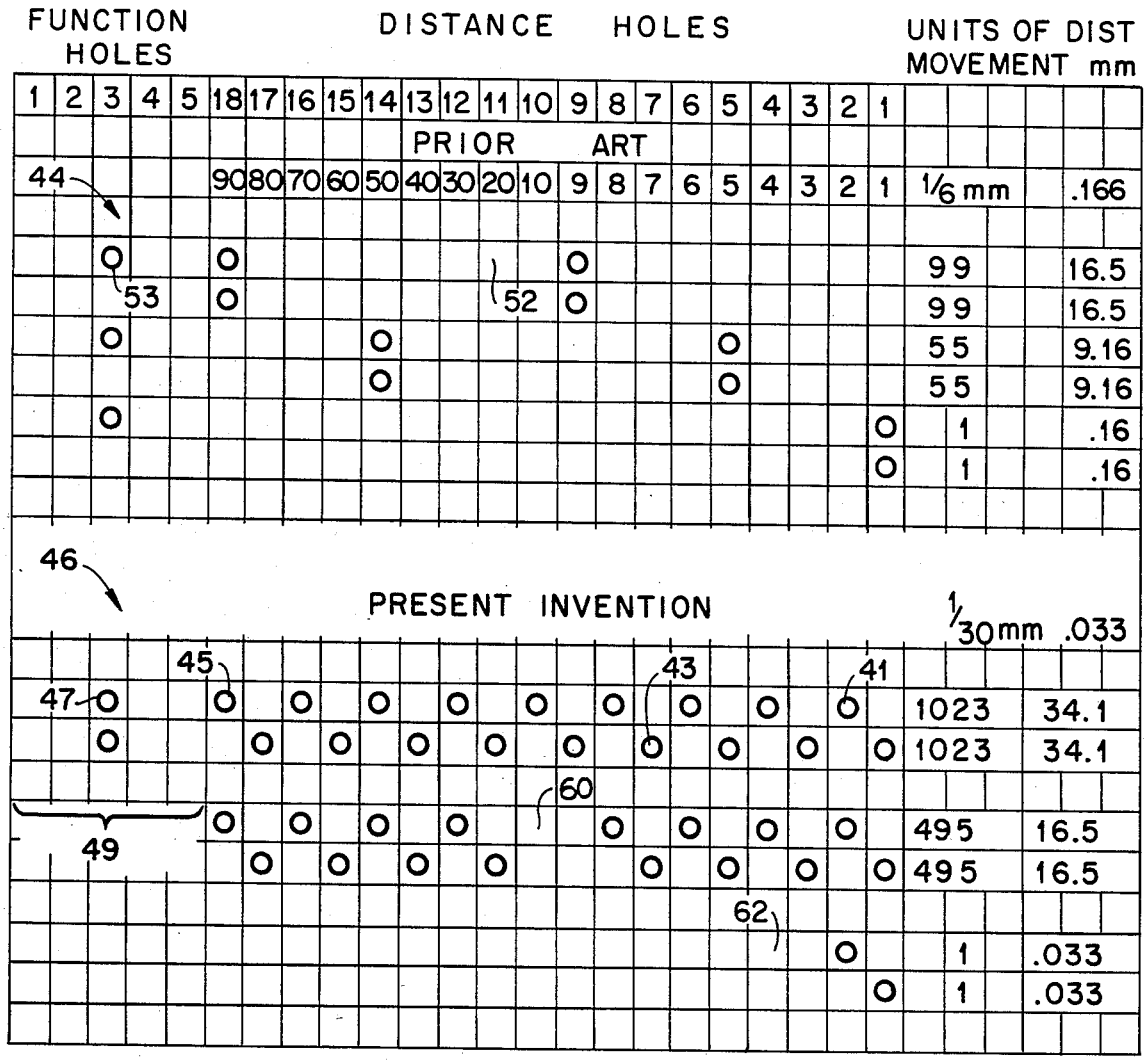
FIG. 3 is an example of one side of a Jacquard tape utilizing the invention.

Referrring now to FIG. 3, this shows the left side or vertical movement side of a tape having both the prior art system 44 with some examples, as well as the system of the present invention 46. As can be seen, the prior art tape and the tape of the present invention utilize the identical space format. Thus only a simple programming change is necessary to enable the hole reading system to conform. More importantly, the prior art system may be easily used interchangeably with the system of the present invention by merely switching the programming in the control electronics 22.

Each row of the tape is divided into 18 distance spaces, as well as 5 function spaces 50. One function space in Column 3 of the prior system indicates plus or minus direction on the X and Y axis. Each space for spaces 1 through 10 indicates 1/6 mm. movement, while the spaces 10 through 90 in increments of 10 indicate increments of 10/6 mm. Thus with holes punched in the 9th and 18th places in line 52, the resultant is 99/6 mm. or 16.5 mm. in the down direction as indicated by the function hole 53. In the Saurer system the maximum stitch length is 17.1 mm. on an axis.

Under the system of the present invention indicated as 46, the same spaces are used as under the prior art system; however, the meaning is vastly altered. Rather than using the weighted values as indicated above, a binary code is substituted. The presence of a hole indicates a one and the absence of a hole indicates a zero. Furthermore, only every other space is utilized per line to indicate a number. This is done so that holes will not appear in adjacent spaces which would mechanically weaken the tape. Furthermore, for each line or row only even spaces are used or only odd spaces are used to distinguish direction. The use of even spaces 41 indicates frame movement in a negative direction, such as, in the case of the example shown in FIG. 3, it would be the down direction, and for odd spaces 43 it would be the positive or, in this example, the up direction.

The hole series or grouping 45 is binary number 111111111, which is 1,023/30 mm. or 34.1 mm. and in the longest stitch on an axis. Thus the stitch length on an axis has been increased from a maximum of 16.5 mm. under the prior art Vomag system to 34.1 mm. in the system incorporated in the present invention. It should be noted that since the stitch direction is indicated by the use of odd or even spaces, the former direction space 47 may now be used as an additional frame movement distance space to increase the possible stitch length by a factor of 2 to form a ten channel system. Furthermore, the other function spaces 49 located on each side of the tape could be used to increase the functional ability of the embroidery machine. If 8 additional spaces were used up to 255 new functions could be added. Again, referring to stitch length, an example of the medium stitch which is shown in FIG. 3 as row 60 is binary number 111101111, which is equal to 495/30 mm. or 16.5 mm., and the shortest stitch as shown, for example, in row 62 is 1/30 mm.

Figure 4:
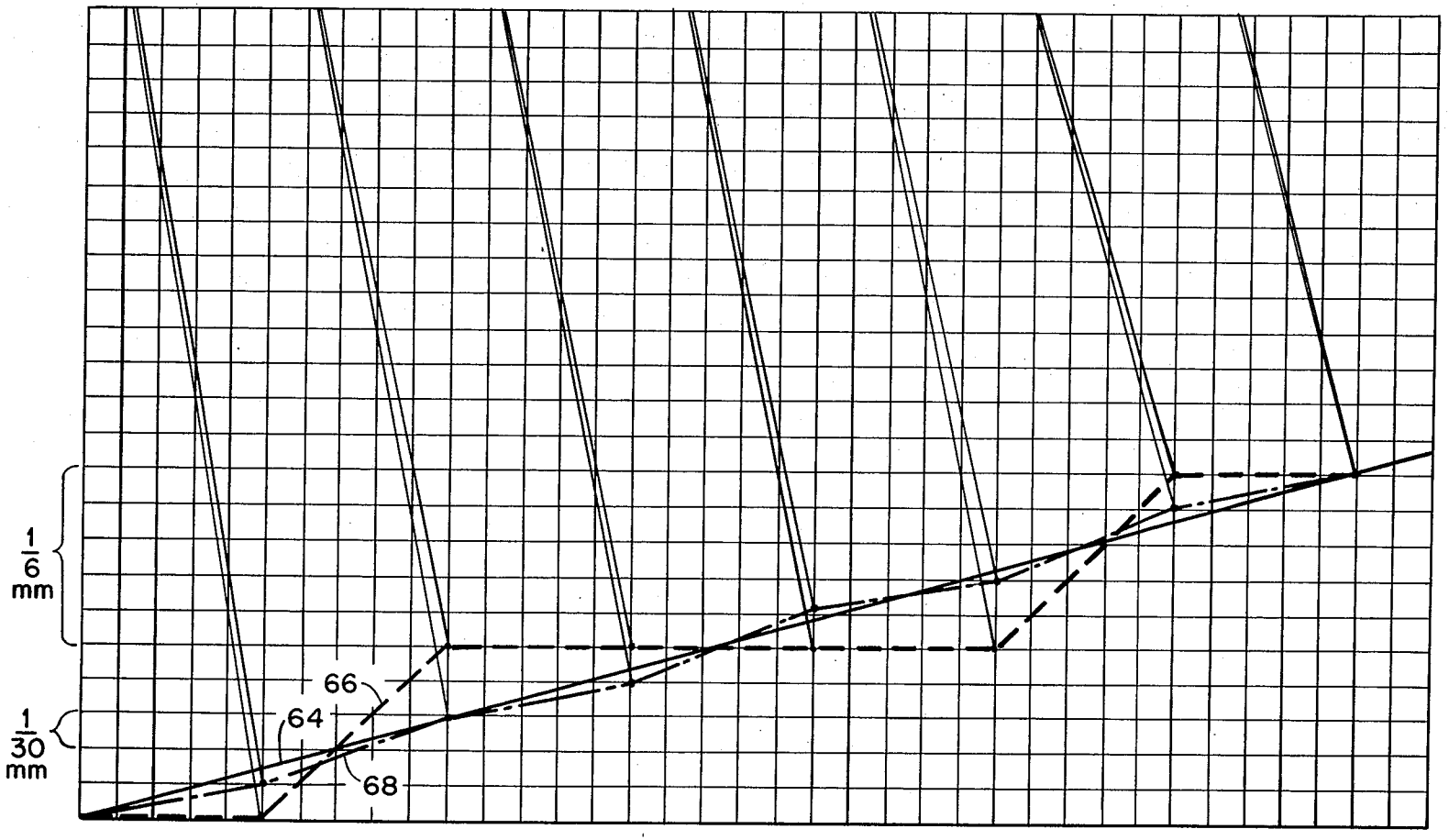
FIG. 4 is a diagram illustrating the improved stitch resolution brought about by Applicant's invention.

Referring now to FIG. 4, it is visually apparent that the system incorporating the present invention greatly increases the stitch resolution on automatic embroidery machines. Line 64 represents the desired line for a series of stitches. Line 66 indicates the resolution obtainable utilizing the Vomag system which has 1/6 mm. resolution. Note the jagged edge of line 66. Line 68 shows the resolution using the binary system of the present invention with the 1/30 mm. stitch resolution.

Figure 5:
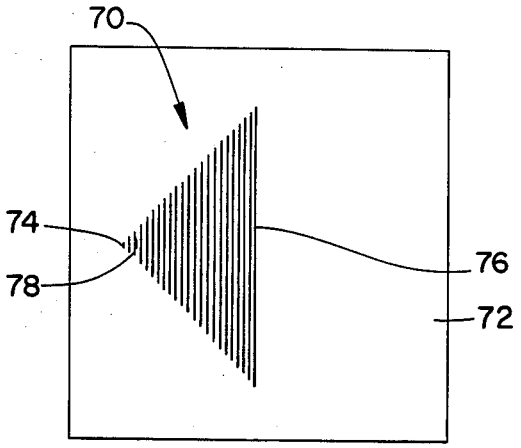
FIG. 5 is a top plan view of a single example of an improved article of the subject invention.

FIG. 5 shows a simple pattern 70 which has been stitched on substrate 72 illustrating (not in proportion for simplicity sake) an improved embroidered article. Stitch 74 is 1/30 mm. in length and is the smallest stitch possible under this system. Stitch 76 is 34.1 mm. in length and is the longest stitch possible on an axis. Stitch 78 is one frame movement increment greater than stitch 74 and is 1/15 mm. in length. Thus the resolution of the stitch length is 1/30 mm. The embroidered article of FIG. 5 has a greatly improved appearance over prior art articles.

Furthermore, as seen in FIG. 3, with the addition of the former direction function spaces the same 18-space format is utilized both in the prior art Vomag system, as well as the system of the present invention. The width of the tape, the distance between adjacent rows and adjacent spaces for receiving holes has not been changed from the Vomag tape format. Thus the same hole punches and the same electro-optical reading machine and electronics, except for obvious programming changes, can be used to read both the Vomag system and the system of the present invention simply by switching from one program to the other. In using the Vomag system five pulses would be transmitted to the drive system for each 1/6 mm. increment of movement. In using the Saurer system three pulses would be transmitted for each 1/10 mm. increment. No mechanical changes are required. Thus an incredible gain in stitch resolution and potential stitch length is provided by changing to a binary-coded system without the necessity of retooling the machines but by only making small changes in the control electronics, which changes may be done by a programmer of ordinary skill in the art.

From the foregoing description of the preferred embodiment of the invention it will be apparent that many modifications may be made therein. For example, in using readers which are set up for the Sauer system all nine spaces are used and, therefore, extra holes could be punched in the margin to indicate direction. Thus it is intended that the appended claims cover all such modifications that fall within the true spirit and scope of the invention.

We claim:

1. A system for improving adjustments of automatically operated embroidery machines having a movable frame comprising:

an elongated tape having a plurality of rows, each row having at least nine predetermined spaces, said tape being of a jacquard type, said spaces adapted to be selectively encoded forming intelligence means on said tape;

a grouping of said intelligence means in each row corresponding to a binary number;

means for reading said binary number from said tape;

means for converting said binary number into electrical pulses;

means for driving the frame of said embroidery machine in the direction and distance in response to said pulses for providing an embroidered stitch;

said intelligence means including holes punched in said tape, the information contained on said tape is substantially equally divided into two sides, one side providing information for frame movement in the X-axis, and the other side providing information for frame movement in the Y-axis;

each side of row having a separate group of holes for forming a separate binary number, the two sides adapted to be read substantially simultaneously whereby the combination of the two numbers dictate the angular direction and distance of the stitch, each side of said tape having at least nine spaces.

2. A system as set forth in claim 1, wherein for each row on a side, the holes are in either in odd spaces or even spaces, holes in odd spaces causing frame movement in one linear direction along one axis and holes in even spaces causing frame movement in the other linear direction along the same axis.

3. A method for improving adjustments of automatic operating embroidery machines having a movable frame comprising the steps of:

providing an elongated jacquard tape having a plurality of rows, each row having at least nine predetermined spaces;

selectively encoding intelligence means in said spaces of said tape; assigning a binary number to the grouping of said intelligence means in each row;

reading said binary number from said tape;

converting said binary number into electrical pulses;

driving the frame of said embroidery machine in the direction and distance in response to said pulses for providing an embroidered stitch; said intelligence means are holes punched in said tape; and further including the steps of:

dividing said tape into two sides, one side providing information for frame movement in the X direction and the other side providing information for frame movement in the Y direction;

providing separate groups of holes for forming a separate binary number on each side;

reading the two sides substantially simultaneously, whereby the combination of the two numbers dictate the angular direction and distance of the stitch, each side of said tape having at least nine spaces.

4. The method as set forth in claim 3, further including the step of providing odd spaces in each row for indicating frame movement in one direction and even spaces in each row for indicating movement in the other direction.

* * * * *